US005547390A

United States Patent [19]

Laherty

[11] Patent Number: 5,547,390

[45] Date of Patent: Aug. 20, 1996

[54] ELECTRICAL PLUG SECURING DEVICE

[76] Inventor: Mark E. Laherty, P.O. Box 662, Ross, Calif. 94957

[21] Appl. No.: 375,386

[22] Filed: Jan. 17, 1995

[51] Int. Cl.[6] ..... H01R 13/62

[52] U.S. Cl. ..... 439/373; 439/457; 439/458

[58] Field of Search ..... 439/452, 456, 439/457, 458, 371, 373

[56] References Cited

U.S. PATENT DOCUMENTS

| | | | |
|---|---|---|---|
| 2,569,037 | 9/1951 | Dalton . | |
| 2,728,058 | 12/1955 | Phalen | 439/373 |
| 3,163,481 | 12/1964 | Salvador | 439/373 |
| 3,708,778 | 1/1973 | McKeever | 439/371 |
| 3,775,729 | 11/1973 | Casper | 439/371 |
| 4,066,313 | 1/1978 | von dem Hagen | 439/371 |
| 4,566,185 | 1/1986 | Bryan et al. | 439/371 |
| 4,618,200 | 10/1986 | Roberts et al. | 439/373 |
| 5,044,976 | 9/1991 | Thompson | 439/373 |
| 5,174,293 | 12/1992 | Hagiwara | 439/373 |
| 5,348,495 | 10/1994 | Kasden | 439/371 |

*Primary Examiner*—David L. Pirlot
*Assistant Examiner*—Yong Kim
*Attorney, Agent, or Firm*—Larry D. Johnson

[57] ABSTRACT

An electrical plug securing device provides a length of material and embodies appendages into which are formed slots. The device is attached to the faceplate of an electrical outlet using a machine screw and the screw hole already provided to affix the faceplate to the outlet. An electrical cord is then plugged into the outlet and the cord is wrapped around the device, going through the slots and being held there by friction. Thus, the plug is prevented from being removed from the outlet inadvertently.

4 Claims, 7 Drawing Sheets

ELECTRICAL PLUG SECURING DEVICE

BACKGROUND OF THE INVENTION

1. Field of the Invention

This invention relates generally to electrical cords and associated hardware, and more specifically to an improved device to prevent an electrical cord being accidentally or unintentionally pulled from an electrical outlet.

2. Description of the Prior Art

It is a common occurrence during the normal use of electrical tools, appliances, or other electrical implements that the electric cord supplying electricity becomes inadvertently removed from the electrical outlet. Most often this is merely an inconvenience, but it also can cause damage to the electric cord, and could even be an electrical hazard.

Various contrivances have been proposed to prevent the accidental or unintentional removal of plugs from outlets. These include devices disclosed in U.S. Pat. Nos. 2,569,037, 3,708,778, 3,775,729, 4,066,313, 4,566,185, 4,618,200 and 5,044,976. However, none of these known devices satisfactorily performs the desired objectives: the devices being too inconvenient to use quickly; or lacking simplicity of operation; or are physically obtrusive; or lacking ease of installation.

It is therefore an object of this invention to provide a means of preventing the plug of an electrical cord from being inadvertently removed from a common, household electrical outlet.

It is a further object of this invention to provide a device that can be attached easily and securely to the electrical outlet.

It is yet another object of this invention to provide an electrical plug securing device that is easy and simple to use.

Other objects and advantages of the invention will become apparent to those of ordinary skill and art as the description of the invention continues.

SUMMARY OF THE INVENTION

The electrical plug securing device of this invention provides a length of material and embodies appendages into which are formed slots. The inventive device is attached to the faceplate of an electrical outlet using a machine screw and the screw hole already provided to affix the faceplate to the outlet. An electrical cord is then plugged into the outlet and the cord is wrapped around the inventive device, going through the slots and being held there by friction. Thus, the plug is prevented from being removed from the outlet inadvertently.

In the preferred embodiment, the electrical cord securing device includes a length of material that is attached to a household electrical outlet in such a way that the device is in a plane parallel to the outlet faceplate and extends away from the outlet roughly perpendicular to a line that connects the two electrical receptacles. Connected to the length of material are appendages into which are formed slots. An electrical cord is then plugged into a receptacle and the electrical cord is wound around the appendages so as to course through the slots. When tension is then applied to the cord it is diverted to the outlet thus preventing the plug from being accidentally removed from the outlet.

DETAILED DESCRIPTION OF A PREFERRED EMBODIMENT

Figure 1:
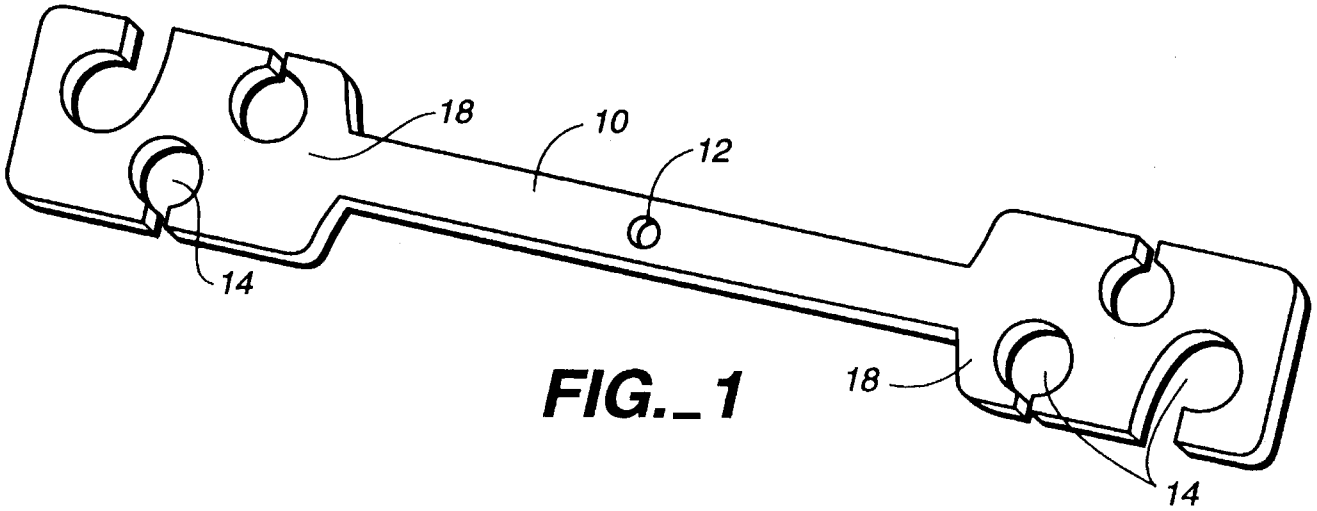
FIG. 1 is a perspective view of one embodiment of an electrical plug securing device of this invention, illustrating a solid strip of rigid or semi-rigid material with a hole in the center for attachment to a faceplate of an electrical outlet, and slots cut into the strip to accommodate an electrical cord.

FIG. 1 shows the invention in the planar form consisting of a piece of rigid or semi-rigid material 10. In this material is a hole 12, through which a machine bolt fits for attachment to the outward face of a common, household electrical outlet. Integrally molded into material 10 are appendages 18 which are formed slots 14 through which the electrical cord will be placed, wrapping around the invention.

Figure 2A:
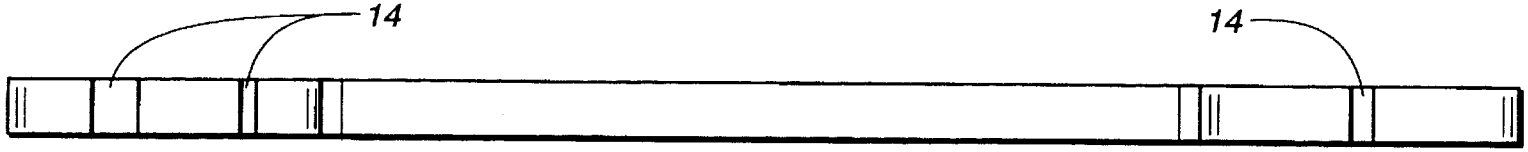
FIGS. 2*a* and 2*b* show side views of the strip in FIG. 1.
Figure 2B:
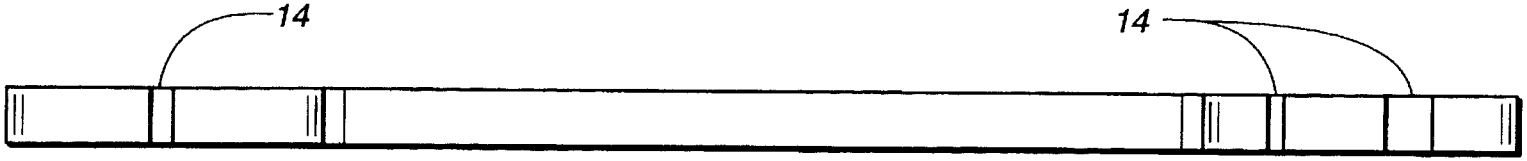

FIGS. 2*a* and 2*b* show the side views of the planar form of the invention and representations of slots 14.

Figure 3:
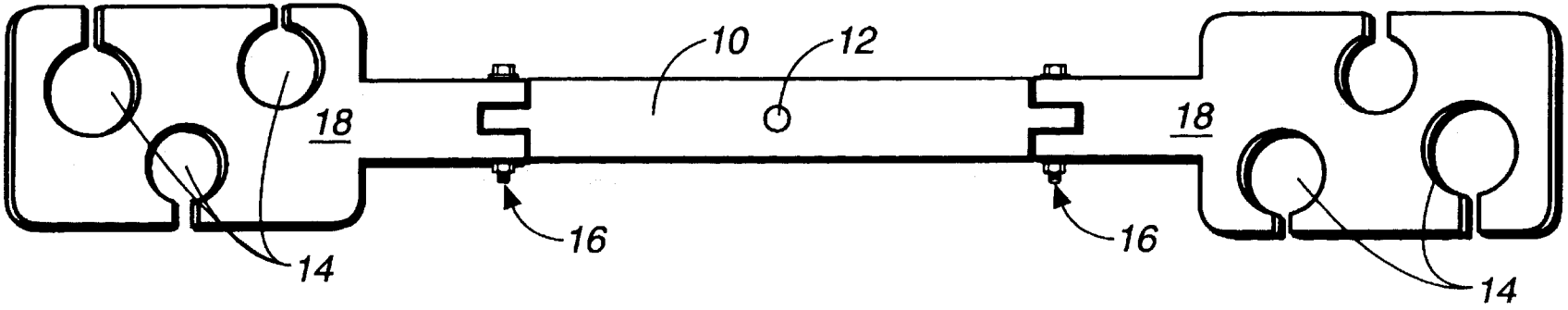
FIG. 3 shows the strip as in FIG. 1 with hinges added to relieve strain.

FIG. 3 shows the material 10 that attaches to the faceplate by a machine screw that goes through hole 12. Appendage 18 is attached to 10 by inserting a pin 16 through complementary holes in 10 and 18 that form a hinge, thus allowing the appendage to rotate about the pin 16. Appendage 18 has slots 14 as before, through which to wind the electrical cord.

Figure 4:
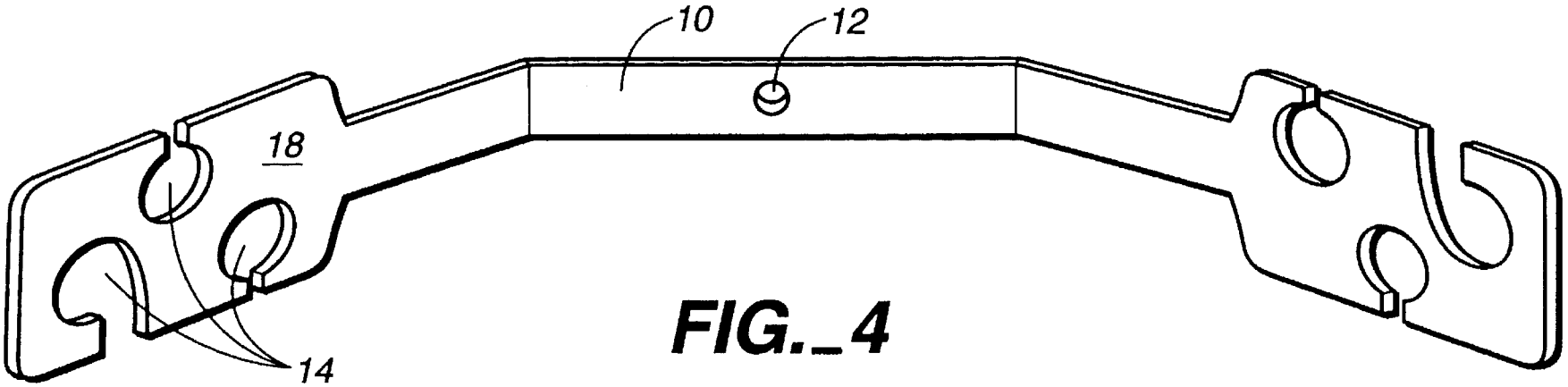
FIG. 4 is a perspective view of an alternate embodiment of the invention, illustrating a strip or rigid or semi-rigid material with slots as before but the strip projects out from the faceplate at an angle.

FIG. 4 shows the material 10 with hole 12 and slots 14 as in FIG. 1, but with the end sections (appendages) 18 bent at an angle to the section 10.

Figure 5:
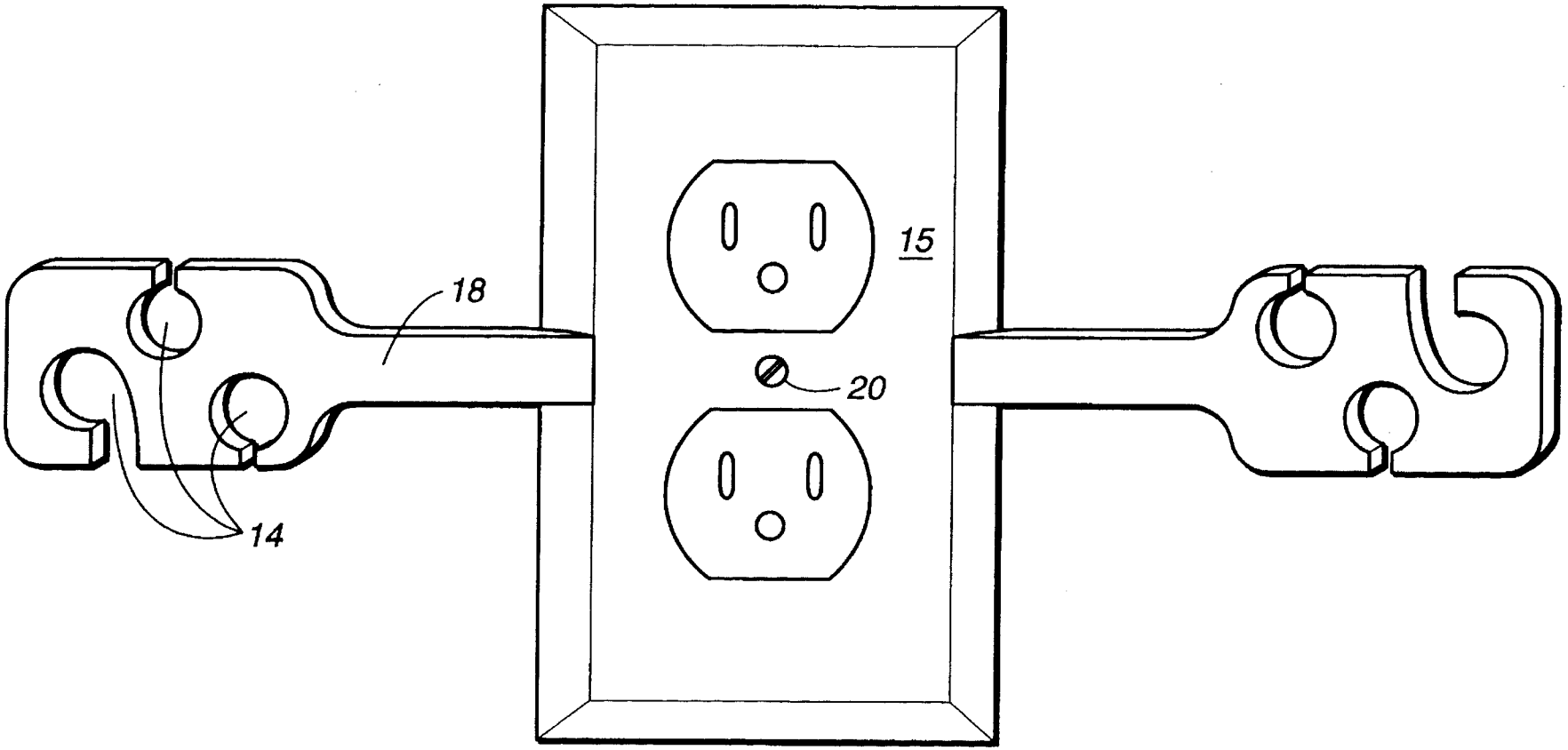
FIG. 5 is a perspective view of a further alternate embodiment of the invention, illustrating a common faceplate to an electrical outlet with integrally molded appendages projecting from the faceplate, with slots in the appendages to accommodate an electrical cord in the manner described herein.

FIG. 5 shows the faceplate 15 of a common household electrical outlet that attaches to the outlet with machine screw 20. The faceplate has the appendages 18 integrally molded into the material of the faceplate and slots 14 in the appendages.

Figure 6:
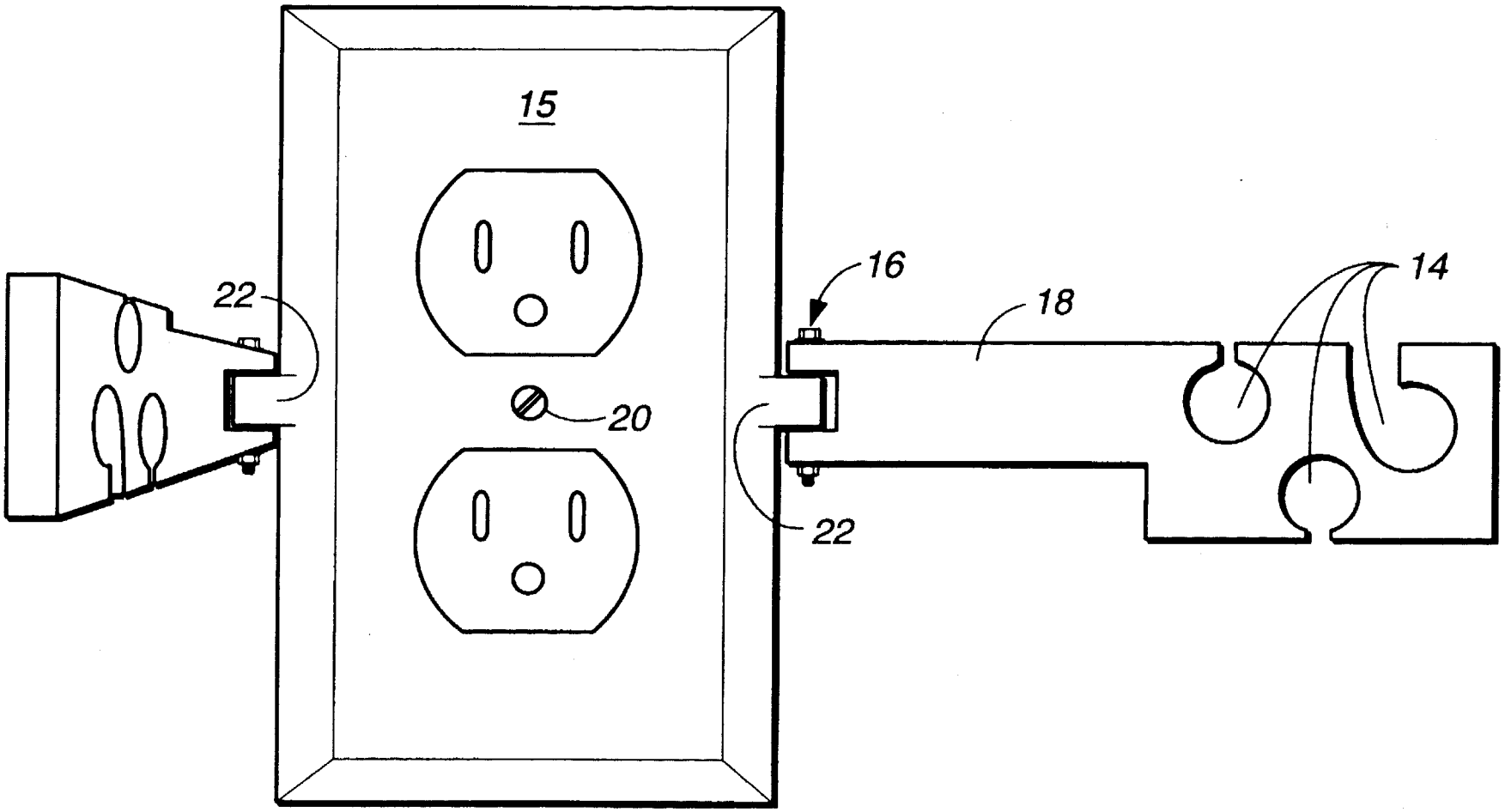
FIG. 6 is a perspective view of a further alternate embodiment of the invention, illustrating the faceplate and common electrical outlet with hinges integrally molded to the faceplate so that appendages with slots can swing on the hinges, relieving strain and holding the electrical cord.

FIG. 6 shows a common household electrical outlet with the invention integrally molded into the faceplate of the outlet. The faceplate 15 is attached to the outlet by the machine screw 20 as in the normal manner. The faceplate has integrally molded extensions 22. The extensions 22 have holes through them and the appendages 18 have complementary holes through them so that when pin 16 is placed through both sets of holes a hinge is formed and appendage 18 can rotate about pin 16. Appendage 18 has slots 14 as before to accommodate the electrical cord.

Figure 7:
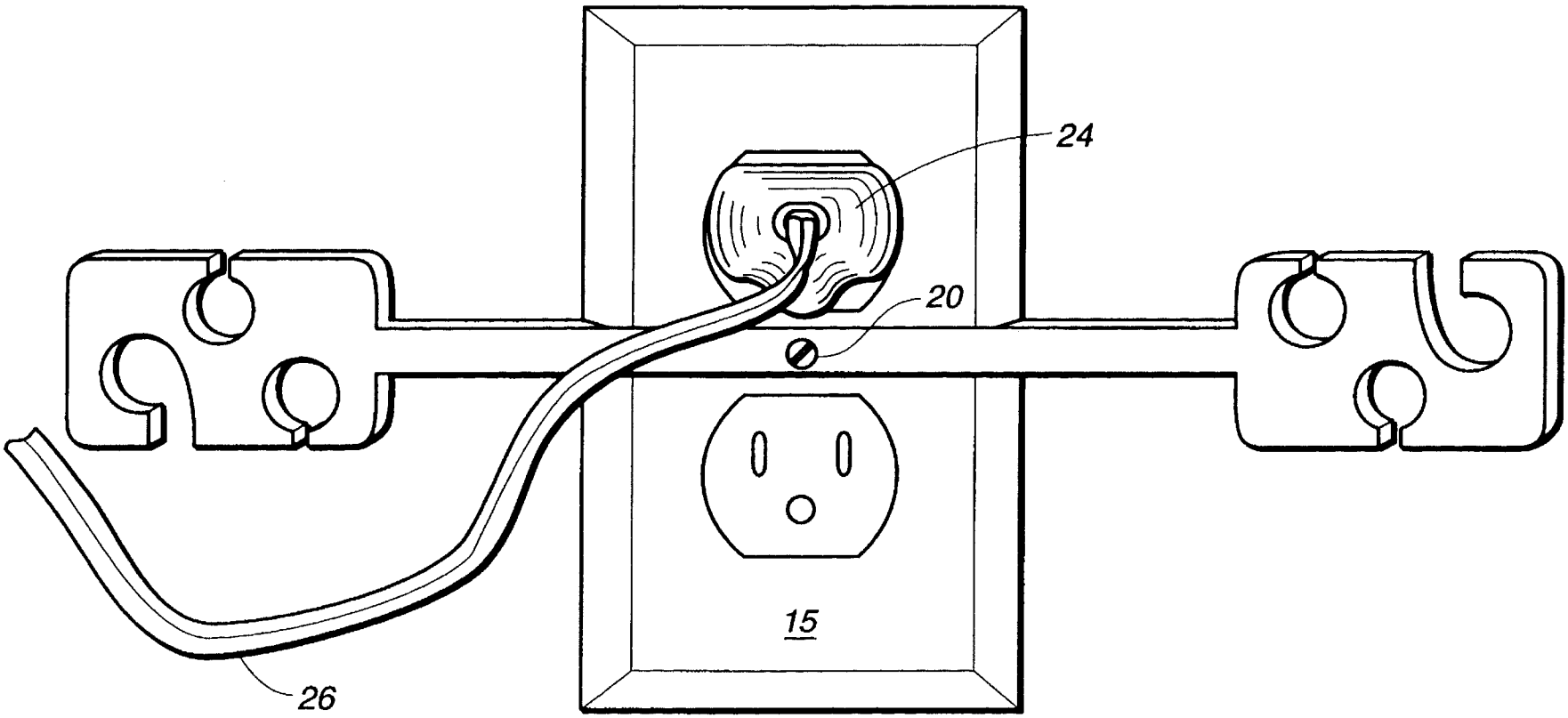
FIG. 7 is a perspective view of the embodiment of FIG. 1, with the inventive device attached to an outlet faceplate, with an electrical cord merely plugged into the outlet and not utilizing the inventive securing device.

FIG. 7 shows a common household electrical outlet with faceplate 15 and the invention attached by machine screw 20. An electrical plug 24 with electrical cord 26 is plugged into the outlet.

Figure 8:
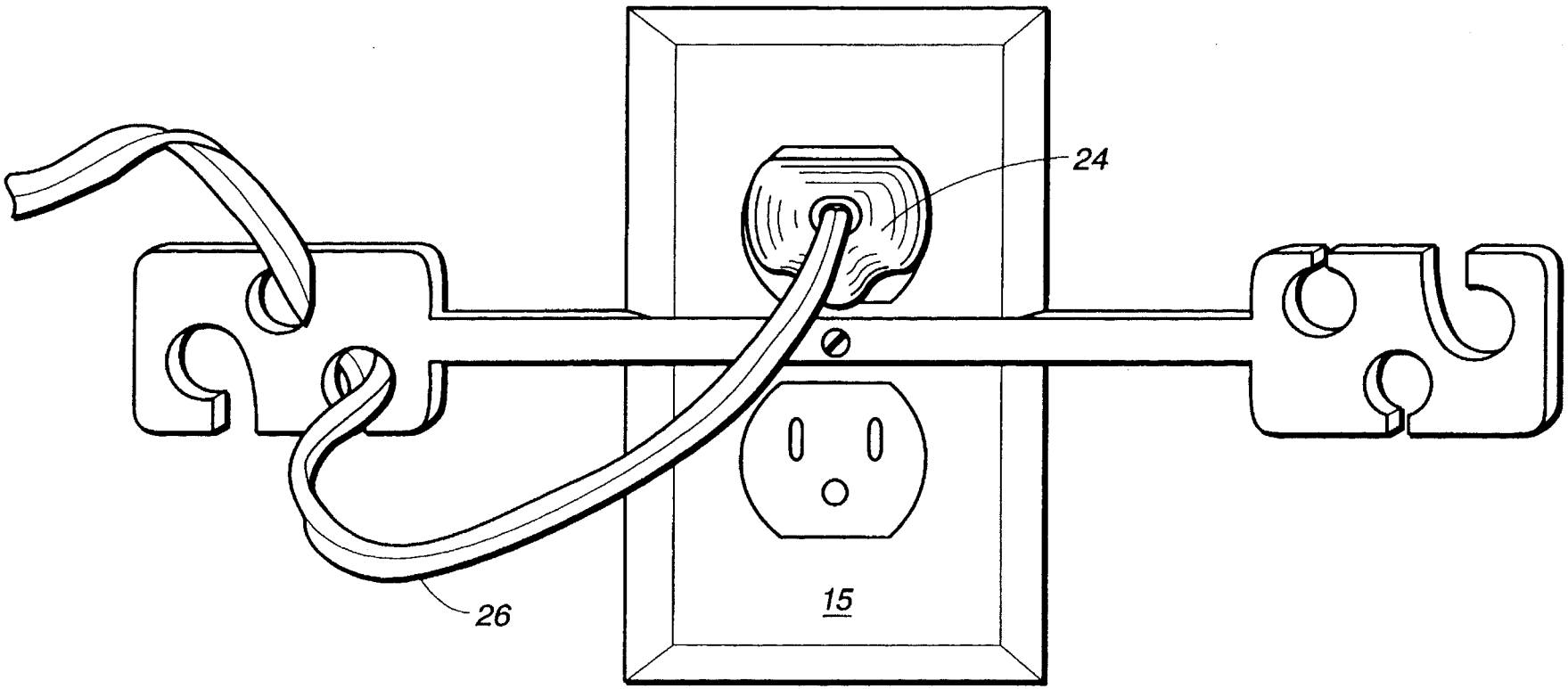
FIG. 8 shows the electrical cord of FIG. 7 having been partially wound through the invention.

FIG. 8 shows the same view as FIG. 7, but with the electrical cord 26 passing through two of the slots in the invention.

Figure 9:
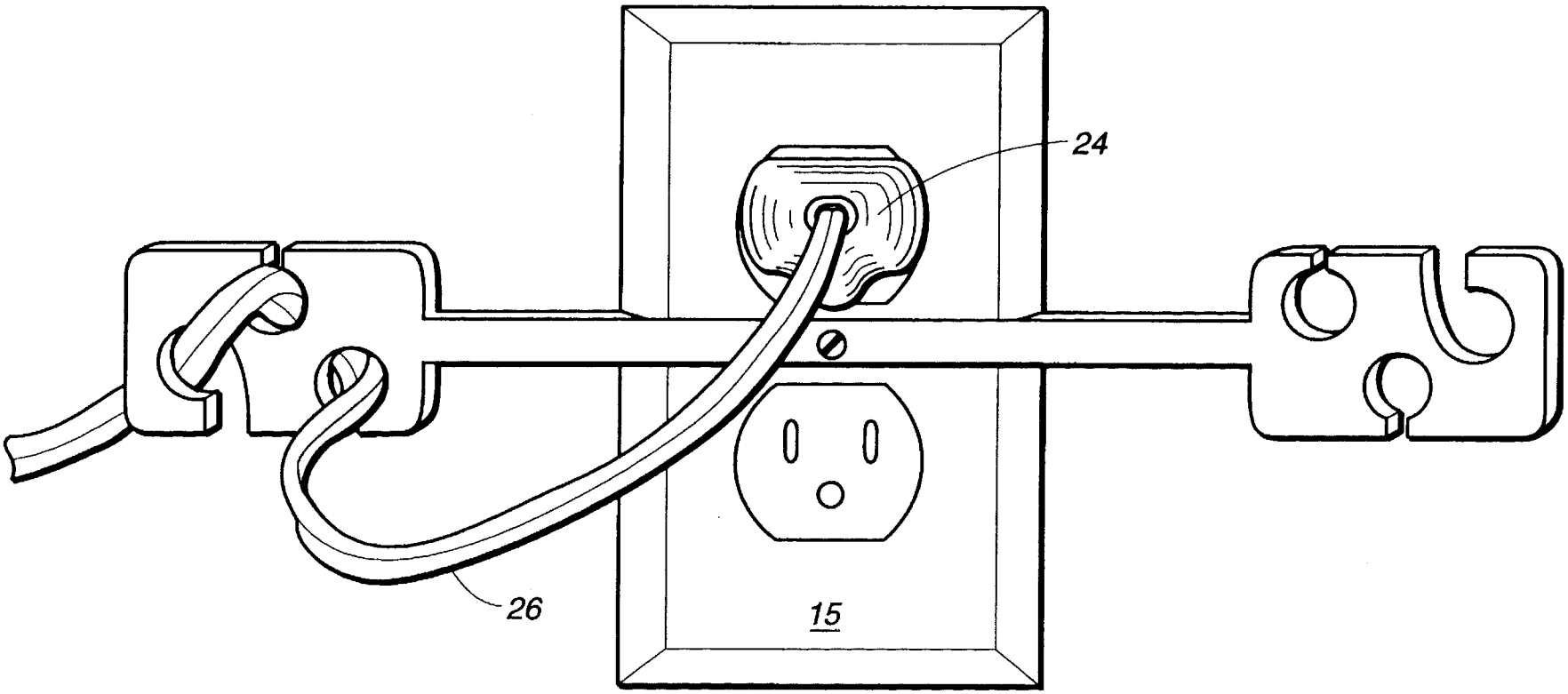
FIG. 9 shows the electrical cord of FIG. 7 having been wound around the invention as in normal use.

FIG. 9 shows the same view as FIG. 8, but with the electrical cord 26 coursing through all three slots in the one side of the invention.

In operation, the user will attach the inventive device to the electrical outlet using the machine screw and hole for attachment of the faceplate. The user will then plug an electrical cord into the outlet and wrap the electrical cord around the invention in a helical fashion causing the cord to course through the slots in the material. The cord is held by friction in the invention and when tension is put on the cord that would normally pull the plug from the outlet the tension is diverted by the invention from the plug to the outlet which is attached to a wall. Thus the plus is prevented from being pulled from the outlet.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and their equivalents.

What is claimed as invention is:

1. A device to prevent the accidental or unintentional removal of an electrical cord plug from a common, household electrical outlet, said device comprising:

a strip of material attached to said electrical outlet;

at least one appendage integrally attached to said strip; and slots formed in said appendage such that an electrical cord, when wrapped around said appendage, may course through said slots in a manner that will inhibit movement of said cord, by friction, when tension is applied to said cord.

2. The device of claim 1 wherein said appendage is connected to said strip by a hinge.

3. The device of claim 1 wherein said strip of material is integrally molded into said faceplate of said electrical outlet.

4. The device of claim 3 wherein said appendage is connected to said strip by a hinge.

* * * * *